US005825637A

United States Patent [19]

Chen

[11] Patent Number: 5,825,637

[45] Date of Patent: Oct. 20, 1998

[54] ADJUSTABLE DESK LAMP

[76] Inventor: Meiric Chen, 73-31 Chiun Lin S. Rd. Hsin Chuang City, Taipei Hsien, Taiwan

[21] Appl. No.: 979,816

[22] Filed: Nov. 26, 1997

[51] Int. Cl.[6] ..... F21V 17/00

[52] U.S. Cl. ..... 362/417; 362/302; 362/361; 362/427; 362/453

[58] Field of Search ..... 362/302, 353, 362/361, 413, 414, 417, 453, 454, 426, 427

[56] References Cited

U.S. PATENT DOCUMENTS

| | | | |
|---|---|---|---|
| 1,974,077 | 9/1934 | Lynch | 362/417 X |
| 4,337,506 | 6/1982 | Terada | 362/142 |
| 5,412,554 | 5/1995 | Lee | 362/449 |

*Primary Examiner*—Stephen F. Husar
*Attorney, Agent, or Firm*—Pro-Techtor International Services

[57] ABSTRACT

A desk lamp which includes a lamp stand, a supporting base revolvably supported on the lamp stand, two support arms symmetrically fastened to the supporting base at two opposite sides, two coupling members respectively connected to top ends of the support arms remote from the supporting base, two lamp shade holder frames respectively pivoted to the coupling members, a lamp holder holding a lamp bulb, two connecting rods bilaterally coupled between the lamp holder and the lamp shade holder frames, a reflector mounted on the connecting rods around the lamp holder, and a lamp shade supported on the lamp shade holder frames around the lamp holder, the lamp bulb and the reflector, the lamp shade having an inside wall coated with a layer of light reflecting substance.

4 Claims, 7 Drawing Sheets

ADJUSTABLE DESK LAMP

BACKGROUND OF THE INVENTION

The present invention relates to desk lamps, and more particularly to an adjustable desk lamp which has a reflecting lamp shade that can be turned to the desired angle to reflect light onto a particular area.

A regular desk lamp, as shown in FIG. 1, is generally comprised of a stand A, a support arm B raised from the stand A, a lamp holder C mounted on the top end of the support arm B remote from the stand A and holding a bulb E, and a lamp shade D fastened to the top end of the support arm B and spaced around the lamp holder C and the bulb E. This structure of desk lamp is still not satisfactory in function. Because the lamp holder C and the lamp shade D are respectively connected to the top end of the support arm B, the lamp shade D must be turned about the lamp holder C when to change the light reflecting angle. When the light reflecting angle is aimed at the user, the user's eyes will directly receive light from the bulb, and the dazzling light from the bulb will irritate the eyes. Another drawback of this structure of desk lamp is that the lamp shade can not reinforce the light intensity of the bulb. Furthermore, because light from the bulb may be directly projected onto the user's face or body, the user's optic nerve tends to be irritated.

SUMMARY OF THE INVENTION

The present invention has been accomplished to provide a desk lamp which eliminates the aforesaid drawbacks. According to the preferred embodiment of the present invention, the desk lamp comprises a lamp stand, a supporting base revolvably supported on the lamp stand, two support arms symmetrically fastened to the supporting base at two opposite sides, two coupling members respectively connected to top ends of the support arms remote from the supporting base, two lamp shade holder frames respectively pivoted to the coupling members, a lamp holder holding a lamp bulb, two connecting rods bilaterally coupled between the lamp holder and the lamp shade holder frames, a reflector mounted on the connecting rods around the lamp holder, and a lamp shade supported on the lamp shade holder frames around the lamp holder, the lamp bulb and the reflector, the lamp shade having an inside wall coated with a layer of light reflecting substance. Because light from the bulb is reflected onto the inside wall of the lamp shade and then reflected by the light reflecting coating of the lamp shade to the designated area, reflected light does not irritate the user's eyes. Because the supporting base is revolvably supported on the stand and the lamp shade holder frames can be turned about the respective screws, the lamp shade can be conveniently adjusted to the desired light reflecting angle.

DETAILED DESCRIPTION OF THE PREFERRED EMBODIMENT

Figure 1:
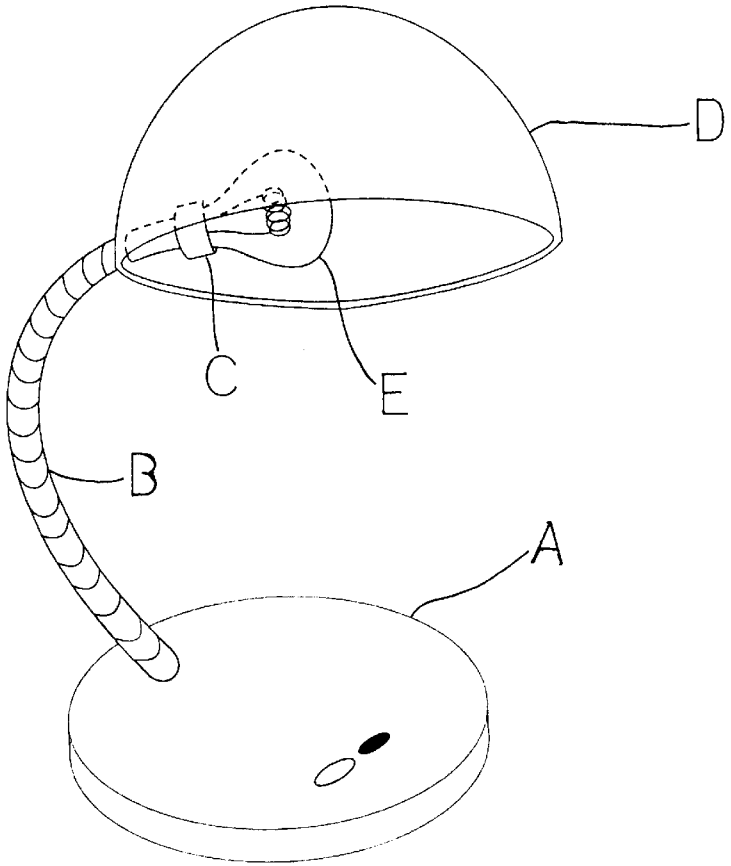
PRIOR ART FIG. 1
FIG. 1 is a perspective view of a desk lamp according to the prior art.
Figure 2:
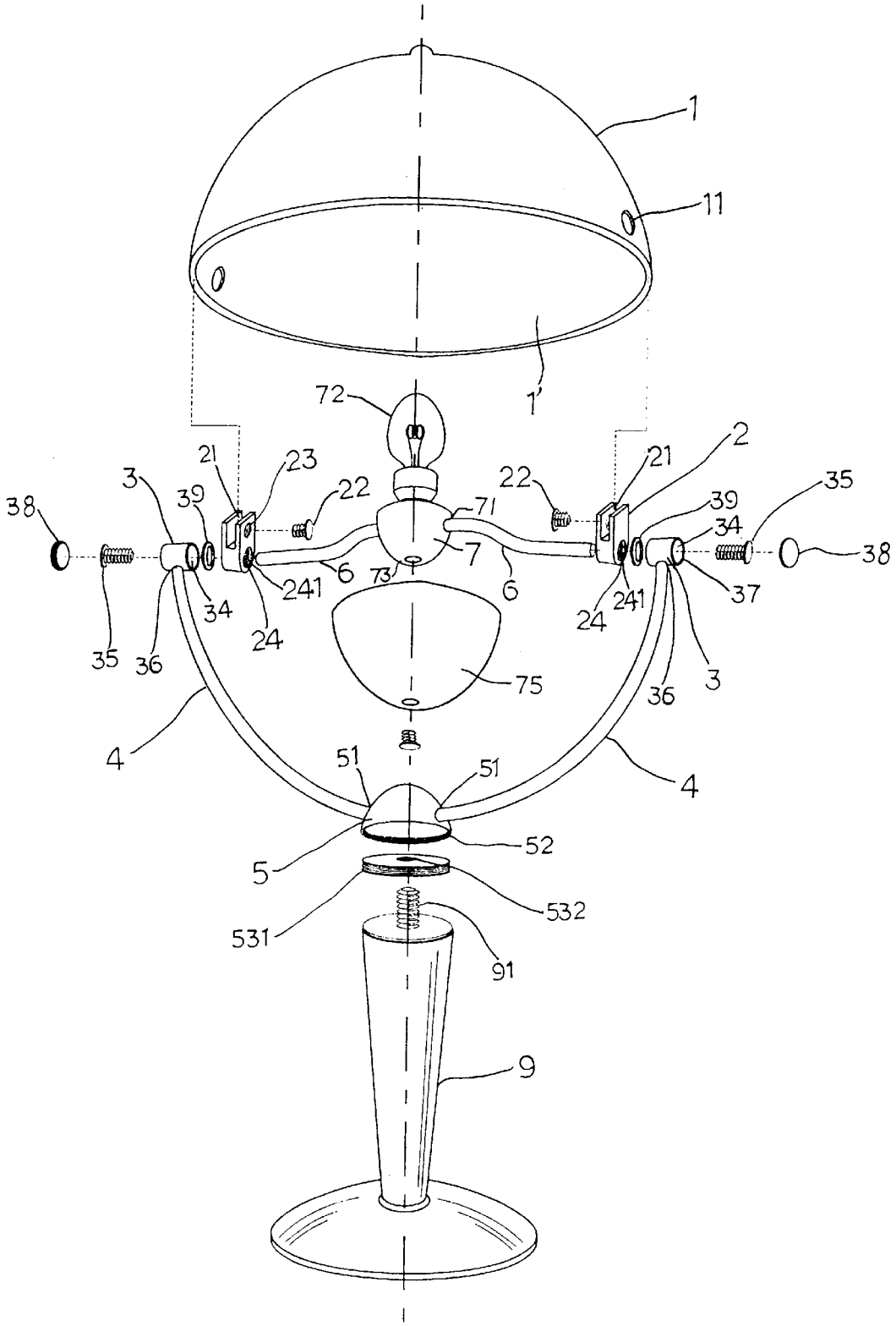
FIG. 2 is an exploded view of an adjustable desk lamp according to the present invention.
Figure 3:
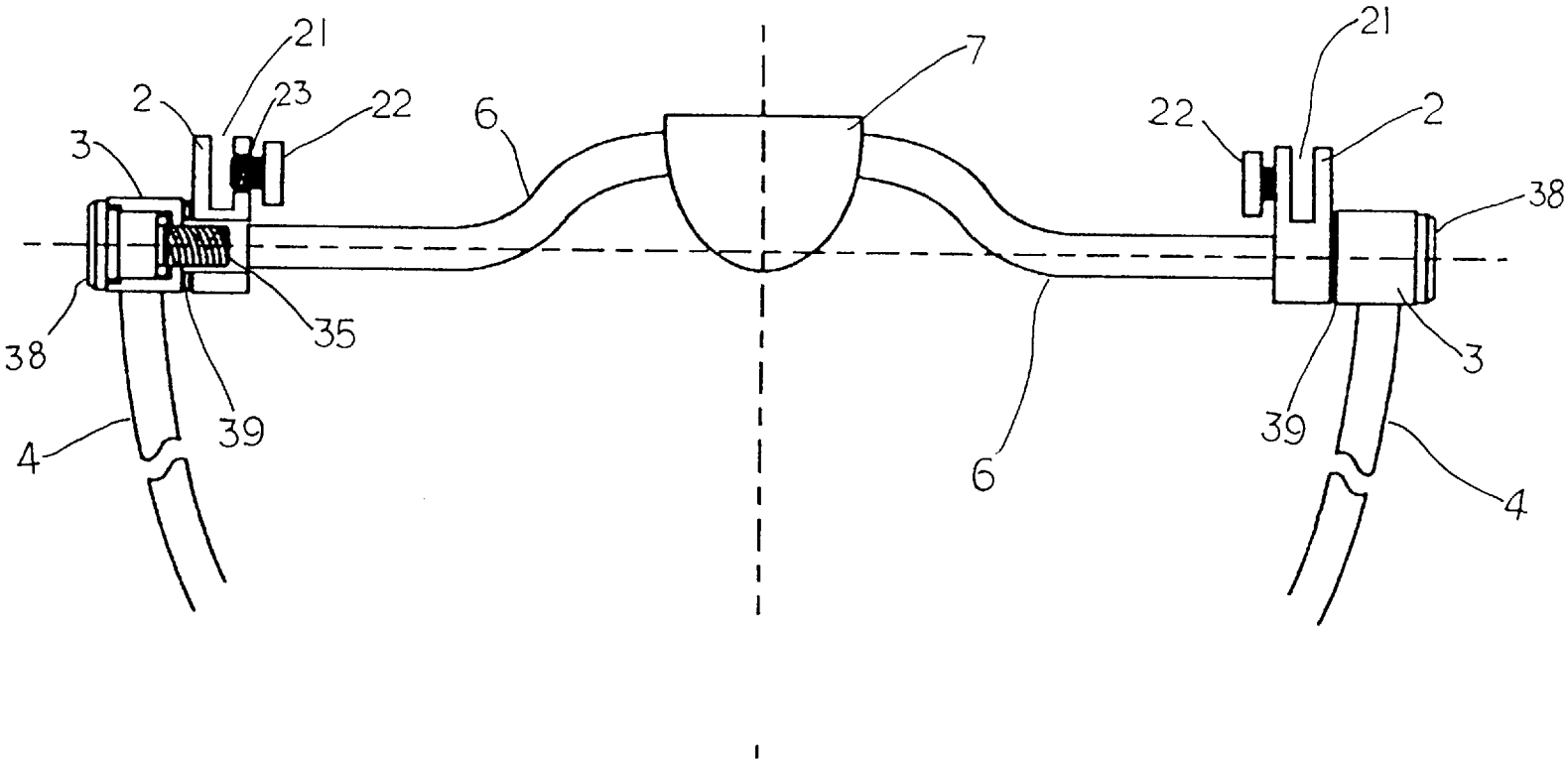
FIG. 3 is a sectional view in an enlarged scale of a part of the present invention.

Referring to Figures from 2 to 5, a desk lamp is shown comprised of a lamp stand 9, a supporting base 5 mounted on the lamp stand 9 at the top, two support arms 4 symmetrically fastened to the supporting base 5 at two opposite sides, two coupling members 3 respectively connected to the top ends of the support arms 4 remote from the supporting base 5, two lamp shade holder frames 2 respectively pivoted to the coupling members 3, a lamp holder 7 holding a lamp bulb 72, two connecting rods 6 bilaterally coupled between the lamp holder 7 and the lamp shade holder frames 2, a reflector 75 mounted on the connecting rods 6 around the lamp holder 7, and a lamp shade 1 supported on the lamp shade holder frames 2 around the lamp holder 7, the lamp bulb 72 and the reflector 75.

The lamp shade 1 is shaped like a hemispherical shell, having two mounting holes 11 disposed at two opposite sides. The lamp shade holder frames 2 are respectively connected between the connecting rods 6 and the coupling members 3. Each lamp shade holder frame 2 comprises an upward mounting slot 21 which receives the border edge of the lamp shade 1, a transverse screw hole 23 at one side in communication with the upward mounting slot 21, a transverse axle hole 24 disposed in parallel to the transverse screw hole 23 below the elevation of the upward mounting slot 21, and an inner thread 241 in the transverse axle hole 24. Two screws 22 are respectively threaded into the transverse screw holes 23 on the lamp shade holder frames 2 and engaged into the mounting holes 11 on the lamp shade 1 to hold the lamp shade 1 to the upward mounting slots 21 of the lamp shade holder frames 2. The coupling members 3 have a hollow cylindrical shape. Each coupling member 3 comprises an axial through hole 34 connected to the axle hole 24 of one lamp shade holder frame 2, and a bottom coupling hole 36 which receives one support arm 4. A screw 35 is inserted into the axial through hole 34 on one coupling member 3 and threaded into the inner thread 241 inside the axle hole 24 on each lamp shade holder frame 2 to fix the coupling member 3 and the corresponding lamp shade holder frame 2 together. A washer 39 is mounted around the screw 35, and retained between the coupling member 3 and the corresponding lamp shade holder frame 2. An end cap 38 is fastened to each coupling member 3 at its outer end 37. The supporting base 5 comprises two mounting holes 51 at two opposite lateral sides, and a bottom screw hole 52. A pad 53 is provided, having an outer thread 531 threaded into the bottom screw hole 52 on the supporting base 5 and a center axle hole 532. The stand 9 has a rod 91 fitted into the center axle hole 532 on the pad 53. The support arms 4 are tubular members, each having a top end fastened to the bottom coupling hole 36 on one coupling member 3 and a bottom end fastened to one mounting hole 51 on the supporting base 5. The connecting rods 6 are tubular members, each having one end connected to the axle hole 24 on one lamp shade holder frame 2, and an opposite end connected to a mounting hole 71 on the lamp holder 7 at one side. The reflector 75 is fastened to the bottom side 73 of the lamp holder 7, and adapted to reflect light from the bulb 72 onto the inside wall 1' of the lamp shade 1. The inside wall 1' of the lamp shade 1 is coated with a layer of light reflecting substance that reflects light.

Figure 4:
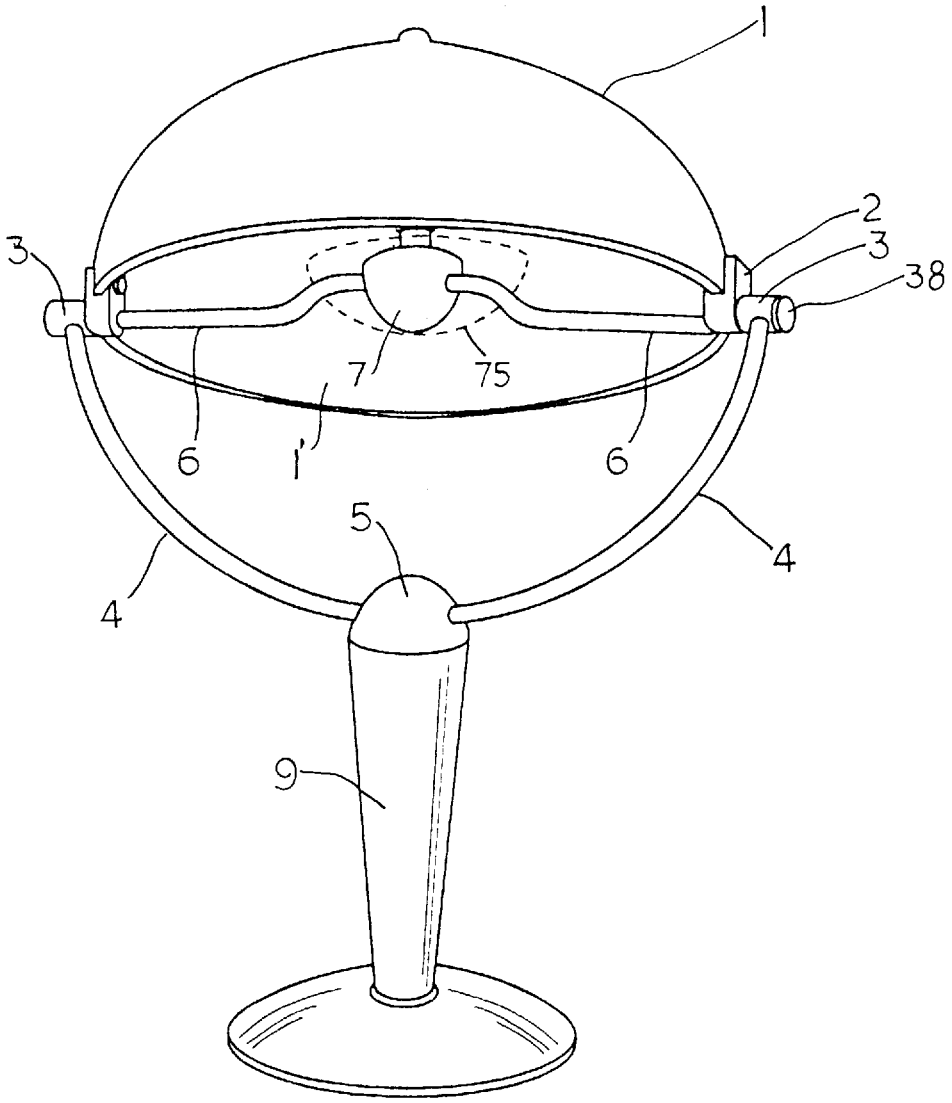
FIG. 4 is a perspective view of the adjustable desk lamp according to the present invention.
Figure 5:
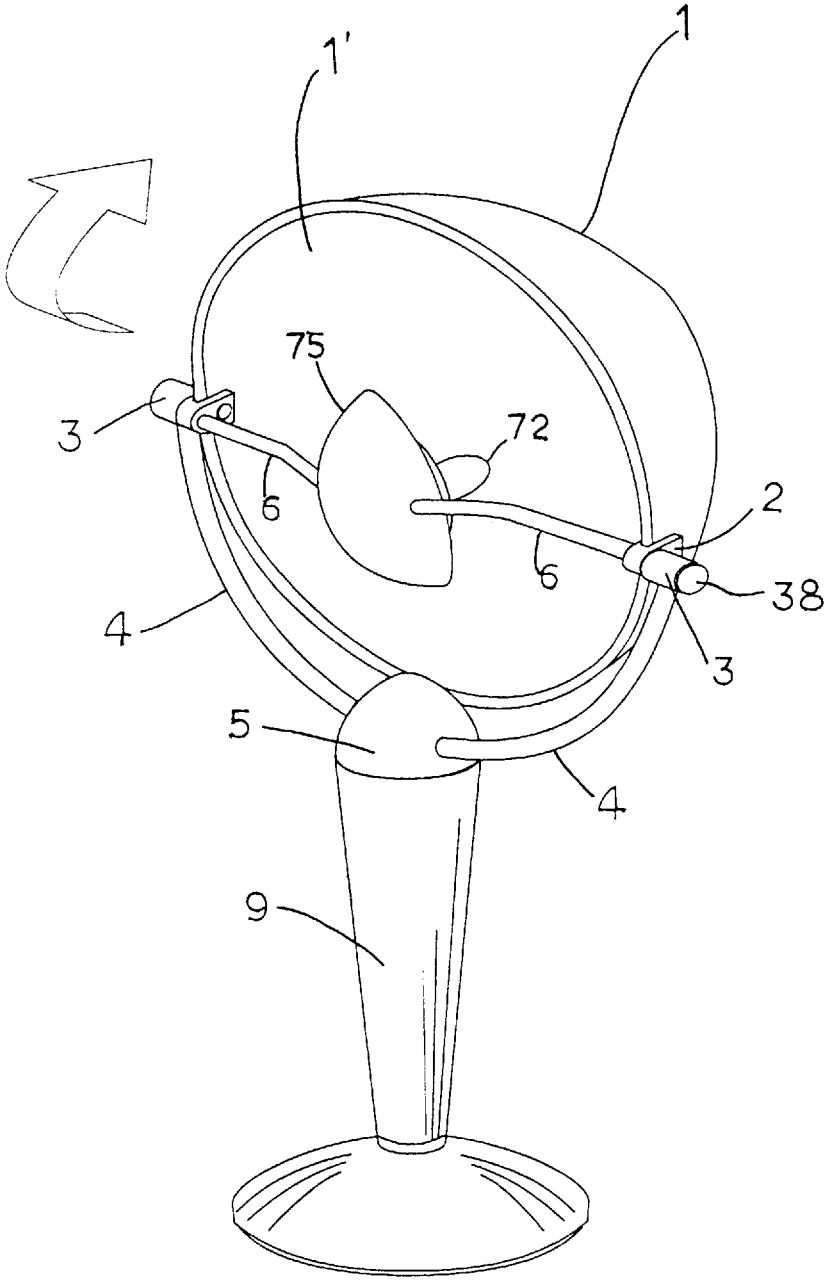
FIG. 5 is an applied view of the present invention, showing the angular position of the lamp shade adjusted.

Referring to FIGS. 4 and 5 again, the lamp shade holder frames 2 can be turned the screws 35 to change the angular position of the lamp shade 1, so as to change the light reflecting angle of the lamp shade 1.

Figure 6:
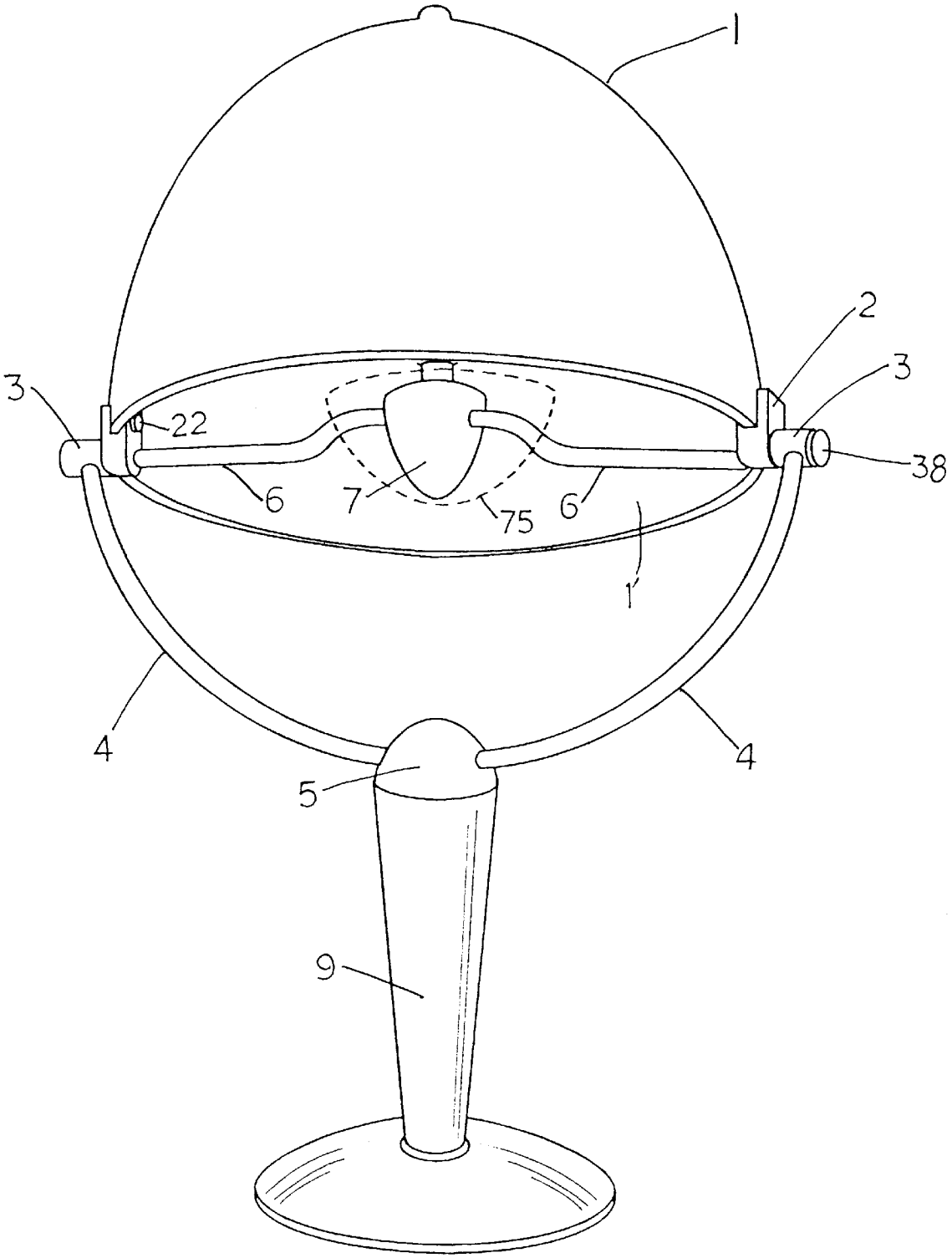
FIG. 6 shows an alternate arrangement of the present invention.
Figure 7:
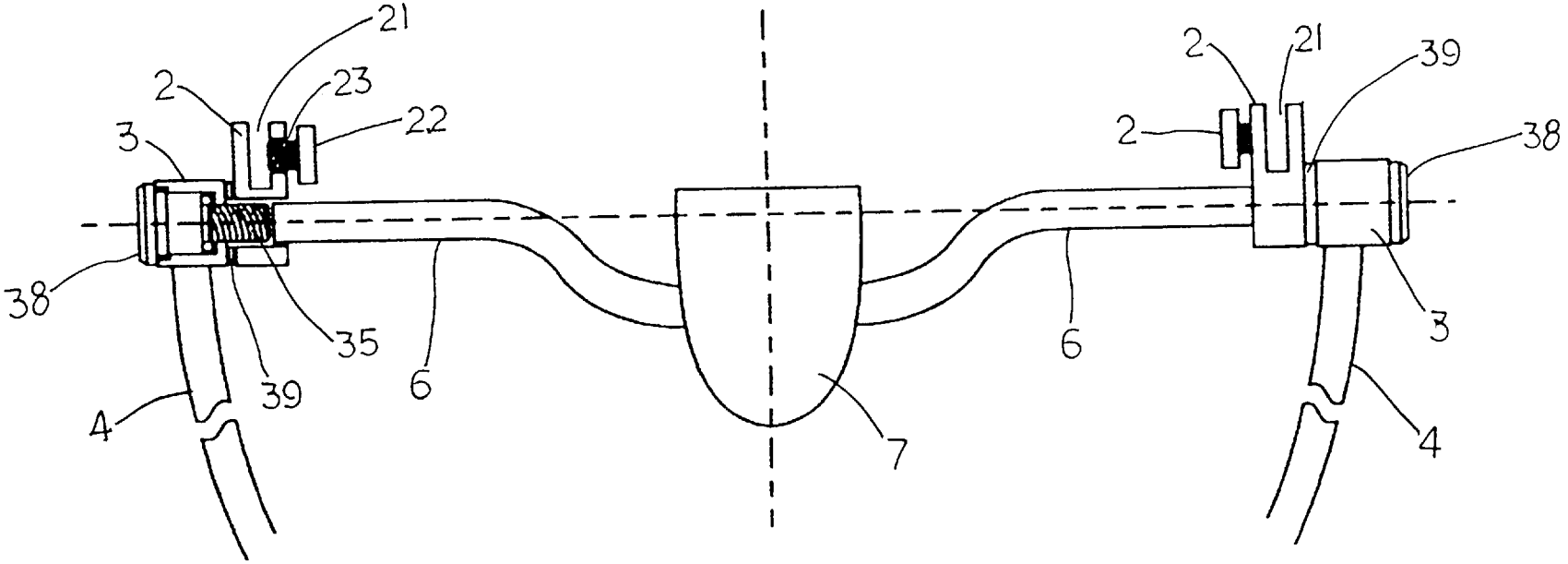
FIG. 7 shows another alternate arrangement of the present invention.

Referring to FIGS. 6 and 7, the connecting rods 6 are curved rods that can be connected between the lamp shade holder frames 2 and the lamp holders 7 in the manner shown in FIG. 6 or the manner shown in FIG. 7. In FIG. 6, the lamp holder 7 is supported on the connecting rods 6 and retained at a relatively higher elevation; in FIG. 7, the lamp holder 7 is supported on the connecting rods 6 and retained at a relatively lower elevation.

It is to be understood that the drawings are designed for purposes of illustration only, and are not intended as a definition of the limits and scope of the invention disclosed.

What the invention disclosed is:

1. A desk lamp comprising:

a stand having a top rod;

a pad mounted on the top rod of said stand, said pad having an outer thread raised from a top side thereof;

a supporting base mounted on said pad, said supporting base comprising two mounting holes at two opposite lateral sides thereof, and a bottom screw hole threaded onto the outer thread of said pad;

two support arms bilaterally connected to said supporting base, said support arms having a respective bottom end respectively fastened to the mounting holes on said supporting base, and a respective top end;

two coupling members respectively mounted on said support arms, said coupling members having a respective bottom coupling hole which receives the top ends of said support arms respectively, and a respective axial hole;

two lamp shade holder frames respectively fastened to said coupling members at an inner side, each of said lamp shade holder frames comprising a transverse screw hole at a bottom side connected to the axial hole on one coupling member by a screw, an upward mounting slot at a top side, and a transverse screw hole perpendicularly disposed in communication with said upward mounting slot;

a lamp shade mounted on the upward mounting slots of said lamp shade holder frames, said lamp shade having two mounting holes at two opposite sides respectively connected to the transverse screw holes on said lamp shade holder frames by a respective screw;

a lamp holder holding a bulb, said lamp holder having two mounting holes at two opposite sides;

two connecting rods respectively connected between said lamp shade holder frames and said lamp holder, each of said connecting rods having one end fastened to the transverse screw hole on one lamp shade holder frame and an opposite end fastened to one mounting hole on said lamp holder; and a reflector fastened to said lamp holder and adapted to reflect light from said bulb onto the inside of said lamp shade.

2. The desk lamp of claim 1, wherein said lamp shade has an inside wall coated with a layer of light reflecting substance.

3. The desk lamp of claim 1, wherein said connecting rods are curved tubular members.

4. The desk lamp of claim 1, wherein said pad has a center axle hole which receives the top rod of said stand, for permitting said supporting base to be turned with said pad about the top rod of said stand.

* * * * *